United States Patent [19]

Plummer

[11] Patent Number: 4,886,196

[45] Date of Patent: Dec. 12, 1989

[54] BODY WORN GOLF ACCESSORY DEVICE

[76] Inventor: Patrick E. Plummer, Rte. 6, Box 507, Fayetteville, N.C. 28311

[21] Appl. No.: 373,246

[22] Filed: Jun. 29, 1989

[51] Int. Cl.[4] ..... B65D 30/10

[52] U.S. Cl. ..... 224/235; 224/252; 224/918; 224/919; 383/43; 383/118

[58] Field of Search ..... 224/252, 253, 918, 919, 224/235, 240; 206/315.5, 319.9; 273/32 D, 162 C; 383/43, 46, 118; D3/104, 36

[56] References Cited

U.S. PATENT DOCUMENTS

| | | | |
|---|---|---|---|
| D. 277,900 | 3/1985 | Reed | D3/104 |
| 1,806,797 | 5/1931 | Guiterman | 224/918 |
| 2,558,382 | 6/1951 | Previdi | 224/918 |
| 2,665,830 | 1/1954 | Fowler | 224/247 |
| 2,682,981 | 7/1954 | Previdi | 224/918 |

*Primary Examiner*—Linda J. Sholl
*Attorney, Agent, or Firm*—Rhodes, Coats & Bennett

[57] ABSTRACT

The present invention entails a device adapted to be worn about the body of a golfer for carrying golf tees, golf balls, green tools, ball markers, etc. In particular, the golf accessory device of the present invention entails a backing that includes a pants clip on the inner side and formed about the outer side of the backing is a series of tee openings for receiving and holding golf tees and other golf related paraphernalia such as a green tool. Depending from the backing is a fabric ball holding pouch that is secured to the backing such that the open top portion of the pouch is secured in a stretched posture which results in the top opening easily assuming a closed position.

5 Claims, 1 Drawing Sheet

BODY WORN GOLF ACCESSORY DEVICE

FIELD OF THE INVENTION

The present invention relates to golf accessories and more particularly to a body worn golf accessory that is designed to carry golf tees, a green tool, and golf balls, etc.

BACKGROUND OF THE INVENTION

For a golfer it is often very annoying to have to carry golf balls, tees, a green tool and ball markers in his or her pocket. Not only is it inconvenient but it can severely restrict and hinder the golfer while playing, especially when executing a swing. It is simply not a pleasant experience attempting to execute a smooth effective swing with a number of golf balls and tees projecting from the golfer's pocket.

In view of this problem, there have been attempts in the past at designing a body worn golf accessory device designed particularly to hold golf balls, tees, a green tool, ball markers and the like. For example, these devices have been disclosed in U.S. Pat. Nos. 2,558,382; 2,665,830; 1,806,797; and D277,900. But such golf accessory carrying devices have themselves not been without disadvantages and drawbacks. For example, it is not uncommon to find such golf accessory carrying devices that are unreasonably large and bulky, difficult to wear in a comfortable manner, and in some cases they are not designed to accommodate all the needs of the golfer.

Therefore, there has been and continues to be a need for a body worn golf accessory device that can be worn comfortably about the golfer while playing golf and which is compact and designed to carry a full range of golf equipment and accessories.

SUMMARY AND OBJECTS OF THE INVENTION

The present invention entails a golf accessory device that is designed to overcome the disadvantages and drawbacks of similar devices previously used. In particular, the golf accessory device of the present invention is designed to be worn about the body of the golfer and includes a leather backing that is provided with a series of vertical openings designed to receive and hold golf tees, a green tool, etc. In addition, the accessory is provided with a pouch-type golf ball holder that is suspended from the leather backing.

It is therefore an object of the present invention to provide a body worn golf accessory carrying device that enables a golfer to conveniently and comfortably carry golf tees, green tool, ball markers, golf balls, etc., within a body worn device.

It is an object of the present invention to provide a golf accessory carrier of the character described above that is compact, relatively simple in construction, easy to manufacture, and quite durable.

A further object of the present invention resides in the provision of a golf accessory carrier of the character described above that includes a backing that is provided with means that form a series of vertical openings that can be used to accept and hold golf tees, a green tool or the like.

Still a further object of the present invention resides in the provision of a golf accessory device of the character referred to above that includes a pouch-type golf ball holder that is designed to hold a series of golf balls and is so designed such that the golf balls are retained within the holding pouch.

Other objects and advantages of the present invention will become apparent and obvious from a study of the following description and the accompanying drawings which are merely illustrative of such invention.

DETAILED DESCRIPTION OF THE INVENTION

Figure 1:
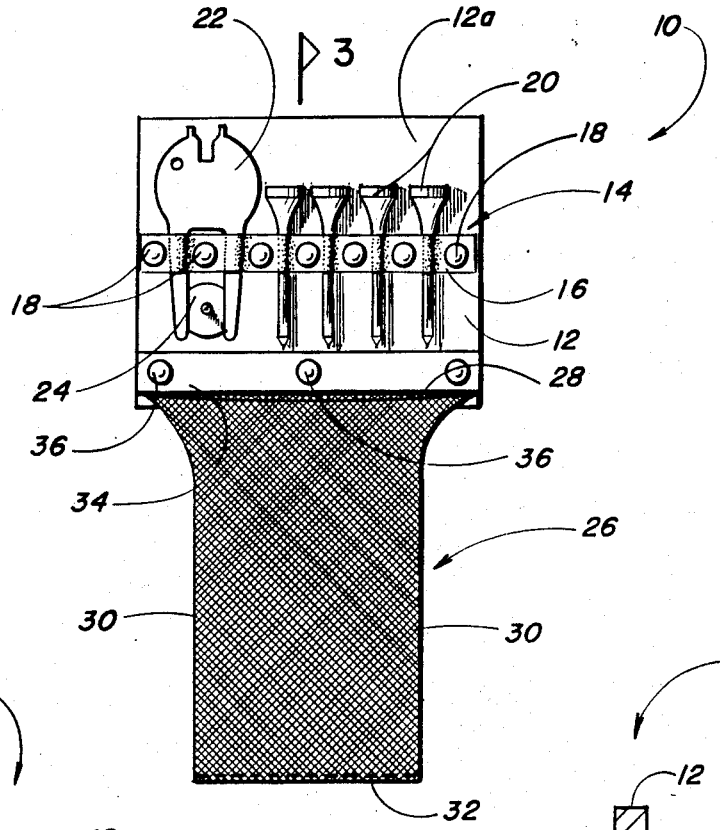
FIG. 1 is a front side elevational view of the body worn golf accessory carrier of the present invention.

With further reference to the drawings, the golf accessory carrier device of the present invention is shown therein and indicated generally by the numeral 10. Carrier 10 as seen in the drawings is designed to be worn about the body of a golfer and is designed to hold and support certain golf accessories or equipment used during the course of the game such as golf tees, green tool, ball markers, and golf balls.

Turning to the device of the present invention it is seen that the same includes a backing 12 that in the preferred embodiment is constructed of leather but it is understood that the same could be constructed of other suitable material. Backing 12 includes an outer surface 12*a* and an inner surface 12*b*.

Formed across the outer surface 12*a* is a flat type retainer indicated generally by the numeral 14. As seen in the drawings, the function of flat retainer 14 is to receive and hold such golf paraphernalia as golf tees 20 or a green tool 22. Note that the retainer strip 14 includes an elastic strip 16 that is pinned or riveted to backing 12 through a series of pins or braids or the like. It is seen that elastic strip 16 is secured to backing 12 in a generally flat and tight fashion and defines a series of side-by-side vertical openings when the elastic strip is expanded by the insertion of golf tees. Essentially, the elastic strip 16 is pinned to backing 12 such that it extends along the backing and is generally held relatively tight against the backing. This forms a series of side-by-side openings that are particularly designed to accept and receive golf tees 20 and even a green tool 22. It will be appreciated that the insertion of tees 20 into the openings formed by the elastic strip will cause the elastic strip to expand and tightly hold the golf tees between the backing 12 and the elastic strip 16. Also as indicated in FIG. 1, note how a ball marker 24 can be held about the backing 12 by inserting the head of the ball marker between the prongs of the green tool 22 and the outer surface 12*a* of the backing 12.

Figure 2:
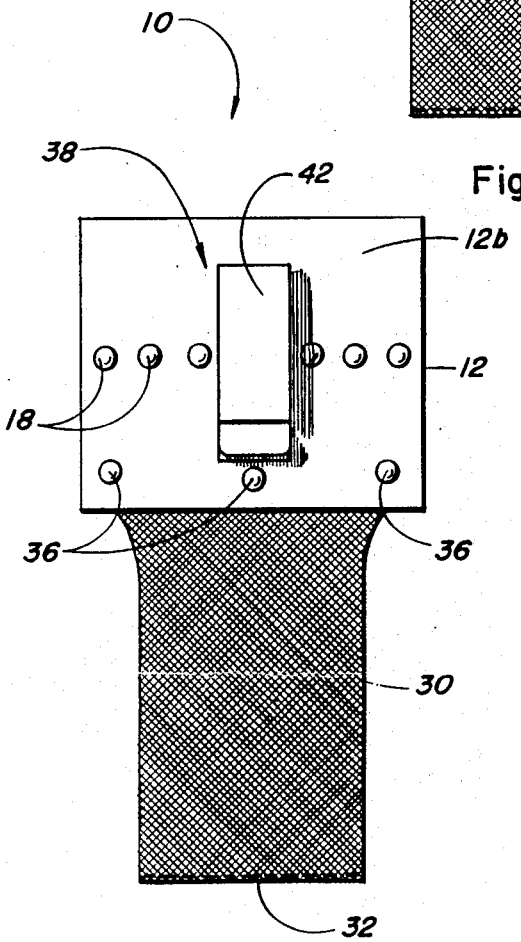
FIG. 2 is a side elevational view of the back side of the golf accessory carrier device of the present invention.
Figure 3:
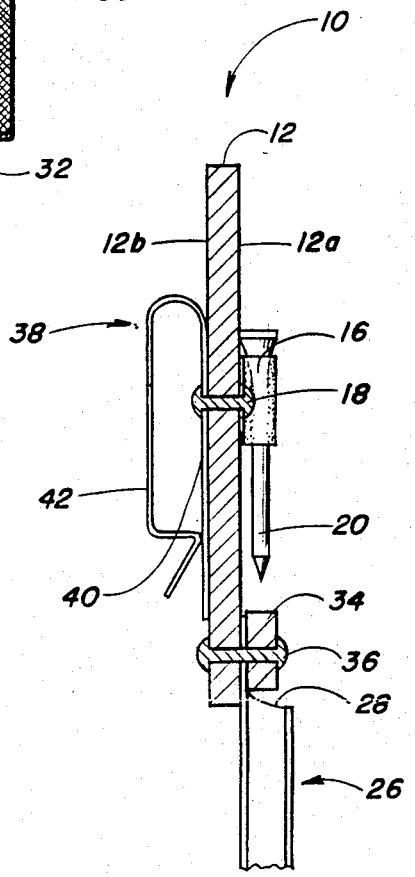
FIG. 3 is a sectional view taken along the line 3 of FIG. 1.

Depending from the lower edge of backing 12 is a fabric ball holder pouch indicated generally by the numeral 26. Note that ball holder pouch 26 includes an open top 28, a surrounding side portion 30, and a closed bottom 32. Preferably the golf ball holder pouch is somewhat elastic inasmuch as the same can be stretched. In view of that, the golf ball pouch 26 is secured to and suspended from the backing 12 about the open top portion 28 of the pouch. As indicated in FIGS. 1 and 2, there is provided a retaining strip 34 that is used to sandwich a portion of the open top to the backing 12. Retainer strip 34 is secured to the lower edge of the outer surface 12*a* of the backing through a series of laterally spaced rivets 36 or the like. The respective rivets extend through the retainer strip 34, through a top portion of the pouch-type ball holder 26 and through the backing 12. Note that the open top portion of the pouch 26 is secured in a stretched posture. This effectively closes the top portion of the pouch and tends to retain the golf balls within the same while the device of the present invention is being worn by a golfer. By simply engaging the outer portion of the open top 28 with one's finger, the open top can be stretched open and golf balls either inserted within the pouch or removed from the pouch.

As referred to above, the carrier device of the present invention is designed to be worn about the body of a golfer. In order to accomplish this function, the backing 12 is provided with a pants clip indicated generally by the numeral 38. It is seen that pants clip 38 includes a back member 40 secured to the inner surface 12*b* and a spring type outer member 42 that loops around and extends adjacent back member 40. Spring member 42 is designed such that it can be pulled from back member 40 and the entire golf accessory carrier 10 can be attached to the pants of the golfer by inserting a top portion of the pants into the area between back member 40 and the forward spring member 42.

From the foregoing discussion and specification, it is seen that the present invention presents a very effective and efficient device for being worn about the body of a golfer for carrying golf accessories such as golf tees and golf balls, etc.

The present invention may, of course, carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A body worn golf accessory carrier, comprising:

(a) a generally flat backing having an outer and inner surface;

(b) a golf tee holding structure formed across the outer surface of the backing for receiving and holding a series of golf tees;

(c) a stretchable fabric ball holder secured to and depending from the backing for holding a plurality of golf balls;

(d) the stretchable ball holder including an open top, a surrounding side structure, and a closed bottom;

(e) means for stretching the open top of the ball holder and securing the open top to the backing in a stretched posture such that the side structure of the ball holder tapers inwardly from the stretched top opening; and (f) means secured to the backing for permitting the golf accessory carrier to be worn about a person.

2. The golf accessory device of claim 1 wherein the golf tee holding structure includes an elongated strip of flexible material that is pinned in a tight posture at selected intervals on the backing so as to form tee insert areas across the backing.

3. The golf accessory carrier of claim 2 wherein the means for securing the golf accessory device about a person comprises a pants clamp having back member secured to the backing and a spring member that lies adjacent the back member and is movable back and forth with respect to the back member so as to give rise to a clamping action, whereby the pants clamp may be secured to the top portion of a bottom apparel worn by a person.

4. The golf accessory carrier of claim 1 wherein there is provided a retainer strip secured to the backing and wherein a portion of the ball holder adjacent the top opening is sandwiched between the backing and the retainer strip in such a fashion that the top opening assumes a stretched open position.

5. The golf accessory carrier of claim 4 wherein the backing is formed of a relatively hard but pliable leather material and wherein the ball holder is constructed of a fabric material.

* * * * *